United States Patent [19]

Akers

[11] Patent Number: 4,621,798

[45] Date of Patent: Nov. 11, 1986

[54] ENVELOPE FEEDING MECHANISM FOR MAIL SORTING MACHINES

[75] Inventor: Roy Akers, Olathe, Kans.

[73] Assignee: Bell & Howell Company, Chicago, Ill.

[21] Appl. No.: 609,544

[22] Filed: May 11, 1984

[51] Int. Cl.[4] ..... B65H 5/02

[52] U.S. Cl. ..... 271/5; 271/31.1; 271/34; 271/150; 271/179

[58] Field of Search ..... 271/4, 5, 8.1, 31.1, 271/149, 150, 151, 94, 34, 179

[56] References Cited

U.S. PATENT DOCUMENTS

| | | | |
|---|---|---|---|
| 3,817,516 | 6/1974 | Lazzarotti | 271/150 |
| 3,988,017 | 10/1976 | Kyhl | 271/150 X |
| 4,275,875 | 6/1981 | Akers | 271/5 |
| 4,299,379 | 11/1981 | Preston | 271/149 X |
| 4,432,540 | 2/1984 | Akers | 271/149 X |

OTHER PUBLICATIONS

IBM Technical Disclosure Bulletin, vol. 13, No. 2, pp. 438, 439, "Horizontal Timing Belt Driven Feed Hopper, F. M. Diel et al.

*Primary Examiner*—Richard A. Schacher

*Attorney, Agent, or Firm*—Kokjer, Kircher, Bradley, Wharton, Bowman & Johnson

[57] ABSTRACT

In a high speed mail sorting machine, a mechanism for feeding envelopes one at a time to a pickoff device such as a vacuum belt system. The envelopes are loaded onto a floor panel which inclines from side to side. A chain conveyor moves the envelope supply along the floor panel with each envelope having its lower edge traveling on the floor and one side edge travelling along an inclined side panel. The envelopes are successively discharged from the inclined floor onto a conveyor belt which is driven transversely to the floor and at a greater speed than the chain conveyor. The speed difference causes the envelopes to spread out as they travel downstream. The conveyor belt loads the envelopes onto a driven roller having a spiral groove which feeds the individual envelopes flatly against the vacuum belts of the envelope pickoff device.

7 Claims, 8 Drawing Figures

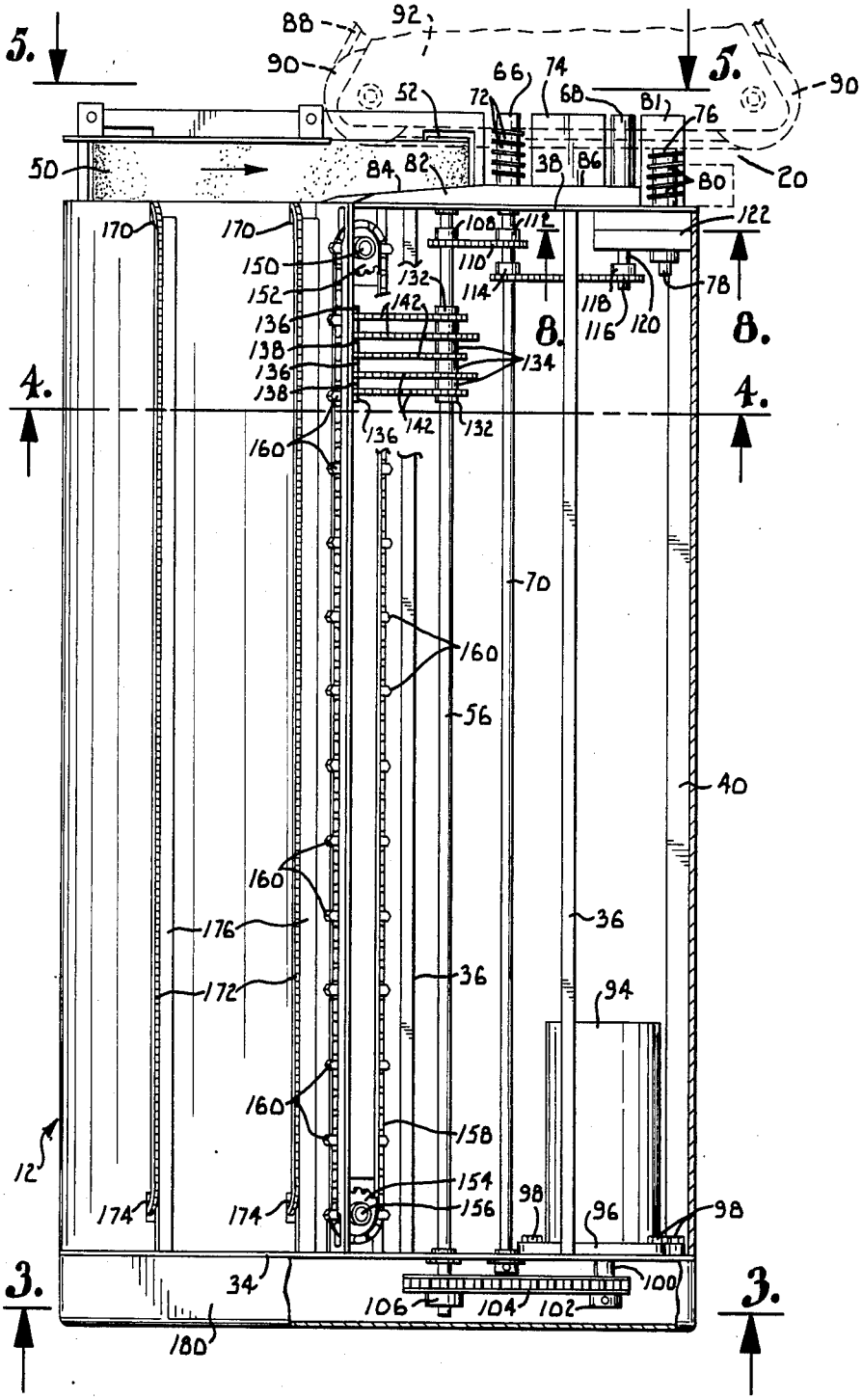
Fig. 2.
Fig. 8.
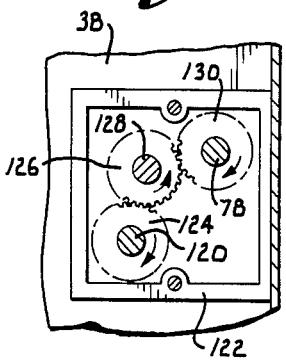
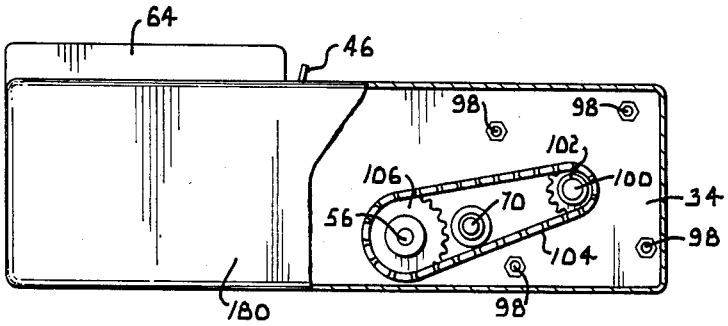
Fig. 3.

ENVELOPE FEEDING MECHANISM FOR MAIL SORTING MACHINES

BACKGROUND AND SUMMARY OF THE INVENTION

This invention relates generally to automated mail sorting equipment and deals more particularly with an improved mechanism for feeding envelopes in a high speed mail sorting machine.

High speed mail sorting equipment is used by various businesses, institutions and governmental units that are faced with handling large volumes of mail. For example, banks, credit card companies, utilities, advertisers and mail order businesses send and receive huge amounts of mail each day. Outgoing mail is typically sorted by zip code prior to mailing. Incoming mail is usually sorted prior to being routed to the proper department.

In order to efficiently sort large volumes of mail, various types of automated, high speed mail sorting machines have been proposed, as exemplified by the machine shown in U.S. Pat. No. 4,275,875 which issued to Roy Akers on June 30, 1981 and assigned to the assignee of the present application. In this type of equipment, the envelopes which are to be sorted are loaded in a stack onto a magazine section of the machine. An envelope feeding mechanism delivers the envelope to vacuum belts which pick the envelopes off one at a time from the envelope supply. The envelopes are thereafter handled individually, and each envelope is conveyed past a reading station at which its zip code or another code imprinted on the envelope is read, either by an operator of the machine or by a code reading device. Envelopes having the same or a similar code are directed into the same storage bins to complete the mail sorting operation.

Although this type of machine has functioned well for the most part, it has not been wholly without problems. A particularly difficult problem has been encountered in providing a reliable arrangement for separating the individual envelopes from the stack in the magazine section of the machine. Vacuum pick off systems have been generally satisfactory, but they rely on proper feeding of the envelopes in order to separate the individual envelopes from the stack one at a time. If the envelopes are bunched tightly together as they approach the vacuum belt, there is a tendency for the envelopes to stick together, and more than one envelope at a time is picked off. Similar problems result if the envelopes are skewed or otherwise improperly positioned as they are fed against the vacuum belts by the feeding mechanism.

It is thus apparent that the pick off device can perform its function properly only if the envelopes are fed to it in the proper manner. Consequently, an effective envelope feeding mechanism is necessary in order for the mail sorting machine to sort the envelopes in a reliable fashion.

The present invention is directed to an improved envelope feeding mechanism for feeding envelopes to a pick off device in a high speed, automated mail sorting machine. It is the principal object of the invention to provide an envelope feeding mechanism which maintains the envelope supply in a relatively loose condition as the envelopes are fed to a pick off device such as a vacuum belt system. Another object of the invention is to provide an envelope feeding mechanism which maintains the envelopes in an upright and non-skewed posture as they are feed to the pick off device.

In accordance with the invention, the magazine section of a mail sorting machine has a floor surface which receives a supply of incoming envelopes with the lower edges of the envelopes resting on the floor. The floor is inclined from side to side, and the side edges of the envelopes rest against an inclined side plate extending along one side of the floor. A drive chain travels along the side plate and has projecting lugs which convey the envelopes along the length of the inclined floor.

At the discharge end of the floor, the envelopes are deposited onto a conveyor belt which is driven in a direction perpendicular to the direction of travel of the envelopes along the magazine floor. The conveyor belt delivers the envelopes to a driven roller having a spiral groove which feeds the envelopes one at a time to the pick off belts. A second grooved roller is elevated to receive the leading edge of each envelope, thereby maintaining the envelopes vertical and square with the vacuum belts against which they are fed.

It is a particularly important feature of the invention that the conveyor belt is driven at a faster speed than the drive chain. The faster speed of the conveyor belt causes the envelopes to spread out as they travel downstream toward the pick off device. Consequently, there is a reduction in the tendency for the envelopes to be tightly bunched together as they approach the pick off device. The relatively loose condition of the envelopes at the time they encounter the vacuum belts reduces multiple envelope picking and other picking problems, thereby enhancing the overall effectiveness and reliability of the mail sorting operation.

DESCRIPTION OF THE DRAWINGS

In the accompanying drawings which form a part of the specification and are to be read in conjunction therewith and in which like reference numerals are used to indicate like parts in the various views:

FIG. 2 is a top plan view on an enlarged scale of the envelope feeding mechanism located in the magazine section of the machine, with portions broken away for purposes of illustration;

FIG. 3 is a fragmentary sectional view taken generally along line 3—3 of FIG. 2 in the direction of the arrows;

FIG. 8 is a fragmentary sectional view on an enlarged scale taken generally along line 8—8 of FIG. 2 in the direction of the arrows.

DETAILED DESCRIPTION OF THE INVENTION

Figures 1, 4, 5, 6, 7:
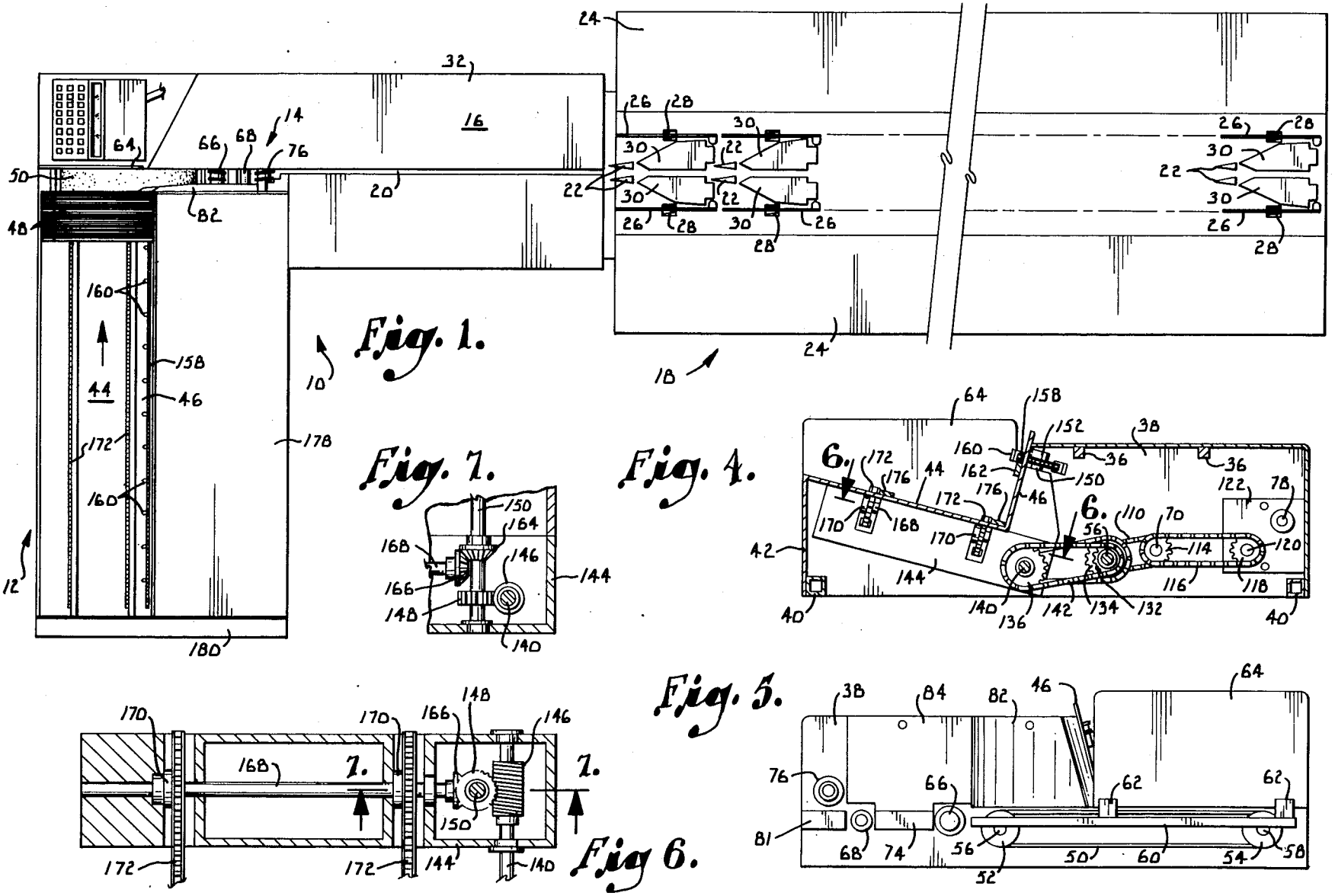
FIG. 1 is a top plan view of a high speed mail sorting machine equipped with an envelope feeding mechanism constructed according to a preferred embodiment of the present invention, with the break lines indicating continuous length of the storage section of the machine.
FIG. 4 is a fragmentary sectional view taken generally along line 4—4 of FIG. 2 in the direction of the arrows.
FIG. 5 is an end elevational view of the envelope feeding mechanism taken generally along line 5—5 of FIG. 2 in the direction of the arrows.
FIG. 6 is a fragmentary sectional view on an enlarged scale taken generally along line 6—6 of FIG. 4 in the direction of the arrows.
FIG. 7 is a fragmentary sectional view taken generally along line 7—7 of FIG. 6 in the direction of the arrows.

Referring now to the drawings in more detail and initially to FIG. 1, numeral 10 generally designates a high speed mail sorting machine of the type in which the envelope feeding mechanism of the present invention can be used. The mail sorting machine 10 is of the same general type as that disclosed in U.S. Pat. No. 4,275,875 issued June 30, 1981 in the name of Roy Akers, which application is incorporated herein by reference.

The principal components of the mail sorting machine include a magazine section 12 which receives the envelopes that are to be sorted, a pick off station 14 at which the individual envelopes are separated one at a time from the supply of envelopes on the magazine section 12, a read station 16 at which the zip code or other sorting code imprinted on each envelope is read, and a storage section 18 which receives and holds the sorted envelopes. The individual envelopes are delivered one at a time past the read station 16 through a guideway 20 which terminates at the input end of the storage section 18. The storage section has a plurality of sets of diverter gates 22 which deflect the sorted envelopes into storage areas 24 located on opposite sides of the storage section. Storage areas 24 can be equipped with a plurality of storage bins (not shown), or the envelopes can be held in separate stacks by hinged plates 26 which cooperate with grooved rollers 28. Guide plates 30 are located adjacent each of the deflector gates 22.

The mail sorting machine 10 can be equipped with a code reading device (not shown) located at the read station 16 beneath a cover panel 32. The code reading device can be an optical code reader or any other suitable type of device capable of reading the codes imprinted on the envelopes. Alternatively, an operator of the machine can read the codes on the envelopes and manually enter the codes on a key board or the like. In any event, suitable electronic circuitry causes one of the deflector gates 22 to deflect the envelope into the proper bin or other storage area in the storage section 18 of the machine.

The present invention provides an improved envelope feeding mechanism for handling the stack of envelopes that are deposited in the magazine section 12. As best shown in FIG. 2, the frame of the envelope feeding section includes a vertical end panel 34 at the input or upstream end of the magazine (the lower end as viewed in FIG. 2). A pair of horizontal frame members 36 are secured at one end to panel 34 and at the opposite end to another vertical panel 38 located adjacent to the pick off station 14. The frame also includes a pair of square tubes 40 which extend horizontally between panels 34 and 38. With additional reference to FIG. 4, the side of one of the square tubes 40 extends along and is secured to a vertical panel 42. The panel 42 extends substantially the full length of the magazine 12.

A floor panel 44 forms an inclined floor surface of the magazine 12. The floor panel 44 extends inwardly and downwardly from the top edge of panel 42 and is inclined from horizontal from side to side. The floor surface 44 extends substantially the entire length of the magazine section 12 of the mail sorting machine. A side panel 46 extends generally upwardly from the edge of the floor panel 44 opposite the edge that connects with panel 42. The side panel 46 is inclined from vertical and forms a right angle with panel 44. The side panel 46 extends the entire length of the magazine section 12. As best shown in FIG. 1, the envelopes 48 that are loaded in a stack onto the magazine section 12 have their lower edges resting on the inclined floor surface 44 and their side edges contacting the side panel 46.

At the downstream or output end of the magazine 12, the envelopes on the floor panel 44 are deposited onto a conveyor belt 50 located beyond the end of the floor and travelling transversely to the floor. As best shown in FIG. 5, conveyor belt 50 is drawn around a pair of rollers 52 and 54. Roller 52 is a driven roller mounted on a horizontal shaft 56. The other roller 54 is an idler carried on an idler shaft 58. The upper run of the conveyor belt 50 receives the lower edges of the envelopes and travels above a horizontal panel 60 which is secured to the frame panel 38. The rollers 52 and 54 project upwardly through openings formed in panel 60.

A pair of blocks 62 secured on top of panel 60 serve to mount a vertical plate 64 at a position to retain the envelopes on the conveyor belt 50. As best shown in FIG. 2, plate 64 is located in line with the inside edge of the conveyor belt. The opposite edge of belt 50 is located beneath the terminal edge of the floor 44. The upper run of the conveyor belt 50 travels in a direction perpendicular to the direction of movement of the envelopes on floor 44, as will be explained more fully.

The conveyor belt 50 delivers the envelopes onto a grooved roller 66 and a cooperating smooth roller 68. The grooved roller 66 is located immediately beyond the downstream or discharge end of the conveyor belt 50 and is carried on a horizontal shaft 70 which extends parallel to shaft 56. The top surface of roller 66 is at approximately the same elevation as the upper run of the conveyor belt 50. As best shown in FIG. 2, the surface of roller 66 is provided with a spiral groove 72 having a width to receive a single envelope 48.

The smooth roller 68 is spaced downstream from the grooved roller 66 a distance less than the length dimension of the envelopes handled by the mail sorting machine. The upper surface of roller 68 is located at approximately the same elevation as the base of the spiral groove 72. A panel 74 is located between rollers 66 and 68 to support the center portions of the lower edges of the envelopes which are loaded onto the rollers.

Another grooved roller 76 cooperates with rollers 66 and 68. Roller 76 is elevated with respect to rollers 66 and 68 and is located a short distance downstream from smooth roller 68. The longitudinal axes of all three rollers 66, 68 and 76 are perpendicular to the direction of travel of the conveyor belt 50. Roller 76 is carried on a horizontal shaft 78, and its surface is provided with a spiral groove 80 having the same pitch as the spiral groove 72 in roller 66. Groove 80 receives the leading side edges of the envelopes that are deposited on rollers 66 and 68 and serves to maintain each envelope in an upright position and the proper orientation to approach the pick off station 14. A horizontal panel 81 is located to one side of roller 68 and directly beneath the elevated roller 76.

The envelopes approaching the downstream end of belt 50 encounter a plate 82 secured to one side of the end panel 38. As best shwon in FIG. 2, the upstream end of plate 82 is gradually thickened to present a beveled surface 84 which directs the envelopes onto rollers 66 and 68. The downstream end of plate 82 is of uniform thickness and provides a flat guide surface 86 oriented perpendicular to the rotational axes of rollers 66, 68 and 76.

The envelope pick off device at station 14 includes a pair of vacuum belts 88 drawn around rollers 90 and located one above the other. The rollers are supported on a frame 92. As the described in the aforementioned Akers U.S. Pat. No. 4,275,875, the belts 88 have openings (not shown) which communicate with a vacuum source in order to draw the flat front faces of the envelopes against the front surfaces of the belts 88. The belts 88 are driven in a direction to convey the envelopes one at a time into the guide way 20 toward the read station 16.

The various components of the envelope feeding mechanism are driven by a single electric motor 94. As best shown in FIG. 2, the motor 94 has a mounting plate 96 which is secured by bolts 98 to the end panel 34 of the magazine frame. Motor 94 drives a horizontal output shaft 100 which carries a sprocket 102 (see FIG. 3). A drive chain 104 is drawn around sprocket 102 and around a larger sprocket 106 mounted on shaft 56. The shaft 56 is supported for rotation by the two end panels 34 and 38.

As previously indicated, roller 52 is mounted on shaft 56 and thereby drives the conveyor belt 50 in the direction indicated by the directional arrow in FIG. 2. A sprocket 108 mounted on shaft 56 receives a chain 110 which is also drawn around a sprocket 112 mounted on shaft 70. The shaft 70 is supported for rotation by panels 34 and 38. Roller 66 is mounted on shaft 70 and is rotated with the shaft in a direction to feed the envelopes one at a time toward the vacuum belts 88 via the spiral groove 72.

A second sprocket 114 is mounted on shaft 70. A chain 116 is drawn around sprocket 114 and around another sprocket 118 mounted on a shaft 120 which extends into a gear box 122. The gear box is secured to panel 38, and shaft 120 extends through the gear box to drive the smooth roller 68 in the same direction and at the same speed as roller 66. The top portions of both rollers 66 and 68 move away from belt 50. As shown in FIG. 8, a gear 124 is mounted on shaft 120 at a location within the gear box 122. Gear 124 mates with and drives another gear 126 mounted on an idler shaft 128. Gear 128 in turn mates with a gear 130 carried on shaft 78. In this manner, the elevated grooved roller 76 which is mounted on shaft 78 is rotated in the same direction and at the same speed as the other rollers 66 and 68.

The envelopes are conveyed along the floor panel 44 by a chain conveyor system which is driven from shaft 56 through a speed reducer arrangement. The speed reducer includes three relatively small sprockets 132 and two larger sprockets 134 all mounted on shaft 56. The small and large sprockets are arranged on shaft 56 in alternating fashion, and only the initial small sprocket 32 rotates with the shaft. The other two sets of small and large sprockets 132 and 134 are mounted loosely on the shaft with the small and large sprocket in each pair rotating together.

The speed reducer further includes three relatively large sprockets 136 and two relatively small sprockets 138 all mounted on a common shaft 140 (see FIGS. 4 and 6). The initial two sets of sprockets (each containing a large sprocket 136 and a small sprocket 138) are mounted loosely on shaft 140 with the two sprockets in each set rotating together. The final large sprocket 136 is the output sprocket of the speed reducer and is mounted rigidly on the shaft 140 in order to drive it.

Five chains 142 are drawn around the sprockets in the speed reducer system with each chain being drawn around one large sprocket on one shaft (56 or 140) and one small sprocket on the other shaft. The first chain is drawn around the initial small sprocket 132 and the initial large sprocket 136. The next chain is drawn around the initial small sprocket 138 and the initial large sprocket 134. The remaining chains are similarly used to drive the sprockets, and the final large sprocket 136 is driven at a much slower speed than the initial small sprocket 132 such that shaft 140 is turned much more slowly than shaft 56.

Referring now to FIGS. 6 and 7 in particular, shaft 140 is a horizontal shaft which extends through and is supported for rotation by a gear box 144. Carried on shaft 140 within the gear box is a worm 146 which mates with and drives a gear 148 carried on a shaft 150 which is inclined at the same angle as the side plate 46.

Shaft 150 carries on its top end a sprocket 152 located adjacent to the downstream end of the side plate 46. A similar sprocket 154 (FIG. 2) is mounted on an idler shaft 156 adjacent the downstream end of the side plate 44. Drawn around the sprockets 152 and 154 is a conveyor chain 158 from which a plurality of spaced apart lugs 160 project. The sprockets 152 and 154 project through slots in the side plate 44 in order to locate half of the conveyor chain 158 in extension generally along the surface of the side plate 44. A bar 162 (FIG. 4) is secured to plate 46 at a location immediately beneath chain 158 in order to prevent undue chain sag. The lugs 160 engage the back surfaces of the envelopes which are loaded on the magazine. The lugs may be spaced apart as desired in order to properly convey the envelope stack along the floor surface 144.

Referring again to FIGS. 6 and 7 in particular, shaft 150 is provided with a mitter gear 164 located within the gear box 144. Gear 164 drives a mating mitter gear 166 carried on one end of a shaft 168. Shaft 168 is supported in the gear box for rotation at a location immediately below and parallel to the floor 44. A pair of spaced apart sprockets 170 are mounted on shaft 168 near the discharge end of the floor 44. Sprockets 170 project upwardly out of gear box 144 and through slots formed in the floor 44. A pair of parallel conveyor chains 172 are drawn around sprockets 170 and around another pair of sprockets 174 (FIG. 2) located near the opposite or input end of floor 44. Sprockets 174 likewise project upwardly above the surface of floor 44 such that the upper runs of the conveyor chains 172 move along the floor surface. Bars 176 are secured to the floor 44 beside the two conveyor chains 122. The lower edges of the envelopes on floor 44 are received on the chains 172 which are driven in a downstream direction to assist chain 158 in conveying the envelope supply along the floor of the magazine.

The components on one side of the inclined side panel 46 are covered by a cover panel 178 (see FIG. 1). The sprockets 102 and 106 and chain 104 are enclosed by a cover 180 which may be secured to the end panel 34.

In operation of the mail sorting machine, the envelopes that are to be sorted are deposited in a stack onto the floor 44 of the magazine section 12. As shown in FIG. 1, the envelopes 48 are arranged side to side with each envelope occupying a vertical plane. The long lower edge of each envelope rests on the conveyor surface provided by floor 44 and the chains 172. One side edge of each envelope rests against the side plate 46 and the chain 158 from which lugs 160 project. The front faces of the envelopes face in a downstream direction.

Motor 94 drives chains 158 and 172 through the drive system and speed reducer in the direction indicated by the directional arrow in FIG. 1. The projecting lugs 160 push against the back surfaces of the envelopes to convey the envelopes from the input end of the magazine (the lower end as viewed in FIGS. 1 and 2) to the discharge end (the upper end as viewd in FIGS. 1 and 2). Chains 172 cooperate with chain 158 in conveying the envelopes. As the envelopes travel along the length of the magazine section 12, they move in a direction perpendicular to their lower edges and perpendicular to the vertical planes occupied by the envelopes. The incline of floor 44 causes the side edges of the envelopes to remain against the side plate 46 for conveyance by the lugs 160.

At the discharge end of the magazine, the leading envelopes 48 are discharged from the floor 44 onto the conveyor belt 50. The conveyor belt 50 is driven in the direction of the directional arrow shown in FIG. 2, and, due to the speed reducer, the belt moves at a speed considerably greater than the speed at which the envelopes travel in the magazine. The conveyor belt 50 conveys the envelopes in a direction parallel to their lower edges or in a direction perpendicular to their direction of travel along floor 44. The vertical plate 64 and the guide plate 82 retain the envelopes on the conveyor belt and prevent them from deviating appreciably from their vertical orientations.

When the envelopes reach the downstream or discharge end of the conveyor belt 50, they are loaded onto the rollers 66 and 68 which feed the envelopes one at a time in a direction perpendicular to the lower edges of the envelopes. The spiral groove 72 is wide enough to accommodate an envelope in each of its convolutions. The leading side edges of the envelope are received in the convolutions of the spiral groove 80 formed in the elevated roller 76. This helps to maintain the envelopes in a vertical orientation as they are fed by the grooved rollers toward the vacuum belts 88. Also, the front faces of the envelopes are held parallel to the adjacent runs of the vacuum belts. Rollers 66 and 76 are rotated at the same speed in order to feed the front surface of each envelope flatly against the adjacent surface of the vacuum belts 88. The vacuum holds each envelope flatly against the belts, and the envelopes are thereby picked off one at a time and individually conveyed into the guideway 20 and then past the read station 16 and into the appropriate storage area in the storage section of the mail sorting machine.

Due to the relatively high speed of travel of the conveyor belt 50 in comparison to the conveyor chains 158 and 172, the envelopes are conveyed on the belt at a faster speed than they travel along the magazine. Consequently, even if the envelopes are bunched tightly together in the magazine, they tend to thin or spread out as they move downstream on belt 50 and are delivered onto rollers 66 and 68. Due to the relatively loose condition of the envelopes as they are fed toward the vacuum belts 88, the envelopes do not tend to stick together, and double picking and other picking problems are thus reduced. In this manner, the envelopes are separated one at a time from the envelope supply which is loaded into the magazine.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a mail sorting machine having a magazine section for receiving a supply of envelopes to be sorted, pickoff means for picking off the individual envelopes one at a time from the envelope supply, and means for sorting and depositing the envelopes in a storage area of the machine, the improvement comprising:

first conveyor means on said magazine section of the machine for receiving the supply of envelopes with the envelopes occupying substantially parallel vertical planes and conveying the envelope supply in a direction generally perpendicular to said vertical planes at a first speed, said first conveyor means having an input end for receiving the envelope supply and a discharge end for discharging the envelopes from said first conveyor means;

second conveyor means adjacent said discharge end of the first conveyor means for receiving the envelopes discharged therefrom and conveying the envelopes in a direction generally parallel to said vertical planes at a second speed higher than said first speed, whereby the envelopes on the second conveyor means tend to spread out from their condition on said first conveyor means;

a first grooved roller having a spiral groove thereon extending about the longitudinal axis of the roller, said groove having a size to receive the lower edge of an envelope discharged from said second conveyor means;

means for mounting said first roller for rotation about said axis with said axis oriented substantially perpendicular to the direction of movement of the envelope on said second conveyor means;

a second grooved roller having a spiral groove extending about the longitudinal axis of the second roller, said groove of the second roller having a size to receive a leading side edge of an envelope;

means for mounting said second roller for rotation about its axis at a location offset from and elevated relative to said first roller to accept in the groove of the second roller the side edge of an envelope having its lower edge in the groove of the first roller, thereby maintaining the envelope in a position to occupy a substantially vertical plane; and drive means for rotating said first and second rollers about their axes to deliver the envelopes one at a time from said second conveyor means to said pickoff means of the mail sorting machine.

2. An envelope feeding mechanism for feeding envelopes to an envelope pickoff device in a mail sorting machine, said feeding mechanism comprising:

a conveyor surface defining a conveyor path extending between an input end and a discharge end of said conveyor surface;

means for conveying a supply of envelopes along said conveyor path at a first speed with the envelopes arranged generally side to side and each envelope having a lower edge travelling along the conveyor surface and oriented generally perpendicular to said conveyor path;

a conveyor belt supported for movement along a predetermined path oriented substantially perpendicular to said conveyor path, said belt having upstream and downstream ends with said upstream end located adjacent the discharge end of said conveyor surface to receive the lower edges of the envelopes discharged therefrom;

power means for driving said conveyor belt along said predetermined path at a second speed greater than said first speed to convey the envelopes along said predetermined path to the downstream end of said conveyor belt;

a first roller supported for rotation adjacent the downstream end of said conveyor belt, said first roller having a spiral groove for receiving the lower edges of the envelopes and feeding the envelopes one at a time to the envelope pickoff device upon rotation of the roller;

a second roller mounted for rotation at a location offset from and elevated relative to said first roller, said second roller having a spiral groove for receiving leading side edges of the envelopes to assist said first roller in feeding the envelopes to the pickoff device upon rotation of the second roller; and drive means for rotating said first and second rollers to feed the envelopes one at a time to said pickoff device.

3. A mechanism as set forth in claim 2, wherein said conveyor surface comprises a floor surface inclined from horizontal to maintain the lower edges of the envelopes inclined from horizontal on said conveyor path.

4. A mechanism as set forth in claim 3, including a side panel inclined from vertical and having a side surface oriented substantially perpendicular to said floor surface for receiving side edges of the envelopes on said conveyor path.

5. A mechanism as set forth in claim 4, wherein said conveying means includes:

a drive member supported for movement along said side surface of the side panel between the input and discharge ends of said conveyor surface;

means on said drive member for engaging the envelope supply in a manner to move the envelope supply along said conveyor path; and means for driving said drive member along said side surface of the side panel.

6. A mechanism as set forth in claim 5, including:

a second drive member supported for movement along said floor surface between the input and discharge ends of said conveyor path, said second drive member being adapted to receive the lower edges of the envelopes on said floor surface; and means for driving said second drive member along said floor surface.

7. A mechanism as set forth in claim 2, wherein said first and second rollers have rotational axes oriented substantially perpendicular to said predetermined path.

* * * * *